US005735547A

United States Patent [19]

Morelle et al.

[11] Patent Number: 5,735,547

[45] Date of Patent: Apr. 7, 1998

[54] ANTI-PHOTOGRAPHIC/PHOTOCOPY IMAGING PROCESS AND PRODUCT MADE BY SAME

[76] Inventors: Fredric T. Morelle, 407 Breckenridge Dr. No. 6, Huntsville, Ala. 35802; Ralph C. Wicker, 194 Oxford St., Apt. #8, Rochester, N.Y. 14607

[21] Appl. No.: 778,916

[22] Filed: Jan. 3, 1997

Related U.S. Application Data

[63] Continuation of Ser. No. 264,610, Jun. 29, 1994, abandoned, which is a continuation-in-part of Ser. No. 930,517, Oct. 1, 1992, abandoned.

[51] Int. Cl.[6] ..... B42D 15/00

[52] U.S. Cl. ..... 283/67; 283/72; 283/93; 283/902

[58] Field of Search ..... 283/89, 92, 902, 283/72, 86–88, 91–95, 67; 356/374

[56] References Cited

U.S. PATENT DOCUMENTS

| | | | |
|---|---|---|---|
| 2,065,605 | 12/1936 | Moore | 283/9 |
| 2,952,080 | 9/1960 | Avakian et al. | 35/2 |
| 3,109,239 | 11/1963 | Wicker | 33/1 |
| 3,675,948 | 7/1972 | Wicker | 283/6 |
| 3,713,861 | 1/1973 | Sharp | 283/6 X |
| 3,862,501 | 1/1975 | Jemseby et al. | 35/2 |
| 4,066,280 | 1/1978 | La Capria | 283/8 R |
| 4,168,088 | 9/1979 | Somlyody | 283/8 R |
| 4,210,346 | 7/1980 | Mowry, Jr et al. | 283/8 R |
| 4,277,514 | 7/1981 | Sugiura et al. | 427/1 |
| 4,303,307 | 12/1981 | Tureck et al. | 350/276 R |
| 4,310,180 | 1/1982 | Mowry et al. | 283/8 |
| 4,325,981 | 4/1982 | Sugiura et al. | 283/902 X |
| 4,506,914 | 3/1985 | Gobeli | 283/70 |
| 4,522,429 | 6/1985 | Gardner et al. | 283/91 |
| 4,582,346 | 4/1986 | Caprio et al. | 283/94 |
| 4,588,212 | 5/1986 | Castagnoli | 283/91 |
| 4,884,828 | 12/1989 | Burnham et al. | 283/92 X |
| 5,018,767 | 5/1991 | Wicker | 283/67 |
| 5,171,040 | 12/1992 | Orndorff | 283/902 X |
| 5,193,853 | 3/1993 | Wicker | 283/902 X |
| 5,197,765 | 3/1993 | Mowry, Jr. et al. | 283/902 X |
| 5,271,645 | 12/1993 | Wicker | 283/902 X |
| 5,297,815 | 3/1994 | Anderson et al. | 283/93 |

FOREIGN PATENT DOCUMENTS

| | | |
|---|---|---|
| 0046327 | 2/1982 | European Pat. Off. . |
| 3602563 | 1/1986 | Germany . |
| 1138011 | 6/1966 | United Kingdom . |

OTHER PUBLICATIONS

Bank of Canada (Press Statement) 27 Nov. 89; "New $50 Bill Features Advanced Canadian Technology" IIII Last Other P.A. IIII.

*Primary Examiner*—Frances Han
*Attorney, Agent, or Firm*—F. T. Morelle

[57] ABSTRACT

Several techniques to acquire a counterfeit proof security document. The invention includes improvements for use with non-replicable image line frequency techniques, as well as stand-along printing techniques, that exhibit electro-optical copy and photographic copy frustration characteristics such as experiences with use of color-graduated (tonally graded) substrates, blooming or flaring print patterns, pixel differentiation of discrete indicia and combinations of these with certain printing ink (or) varnish under/overcoat.

13 Claims, 5 Drawing Sheets

FIG. 4A
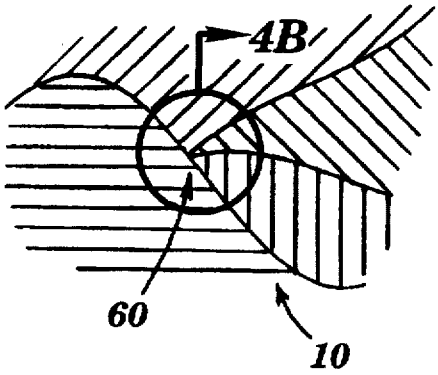
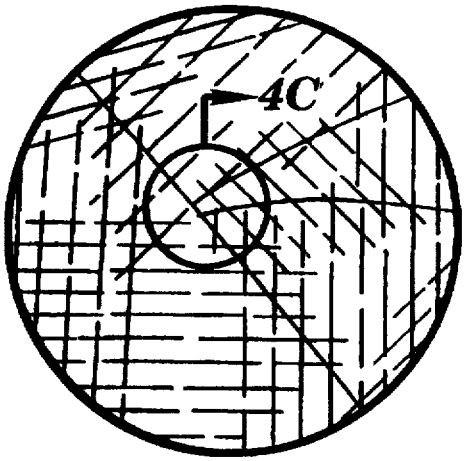
FIG. 4B
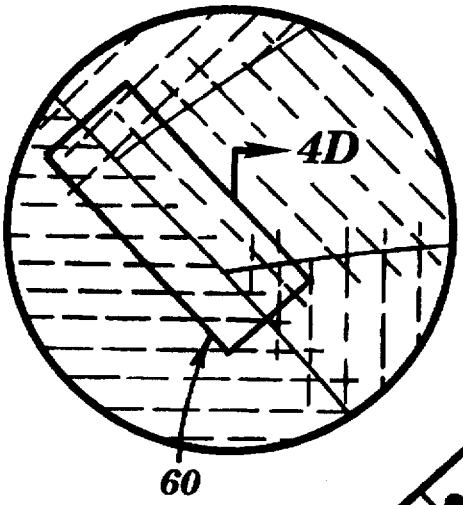
FIG. 4C
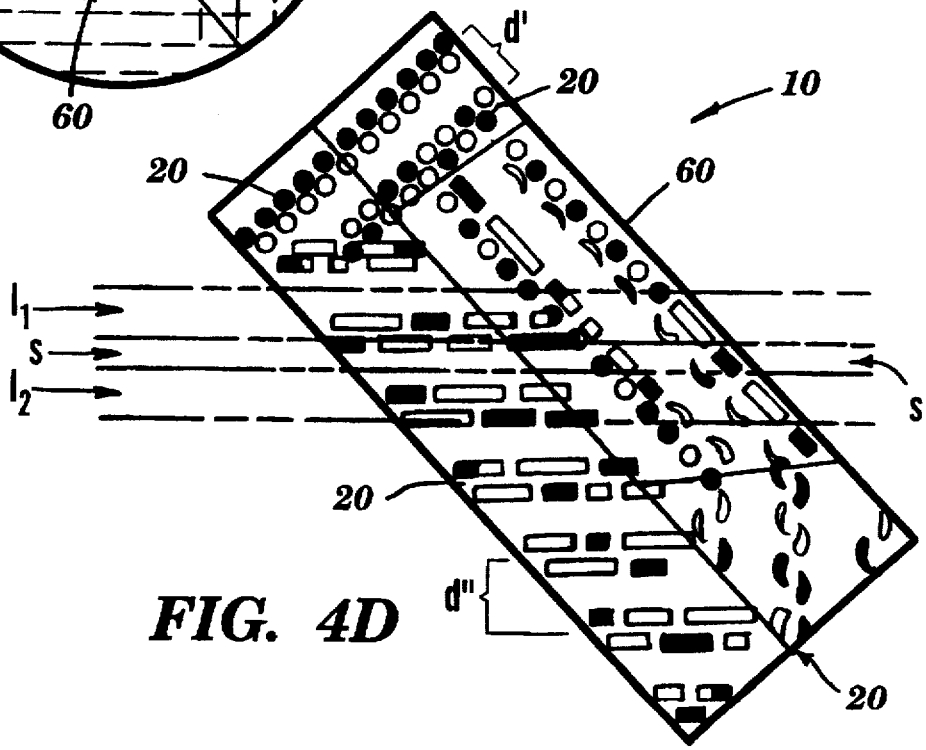
FIG. 4D

FIG. 5C $P_s(l_1, l_2)$

ANTI-PHOTOGRAPHIC/PHOTOCOPY IMAGING PROCESS AND PRODUCT MADE BY SAME

This application is a continuation of application Ser. No. 08/264,610, filed Jun. 29, 1994, now abandoned which was a continuation-in-part of U.S. application Ser. No. 930,517, filed Oct. 1, 1992 (now abandoned), which was based upon and derived from priority document PCT/US 91/00713, U.S. application Ser. No. 473,903, filed Feb. 2, 1990 (now abandoned), which claimed priority of U.S. application Ser. No. 298,020, filed on Jan. 18, 1989 and which issued May 28, 1991 as U.S. Pat. No. 5,018,767.

FIELD OF THE INVENTION

This invention relates generally to protected documents, those documents having some intrinsic value that is readily recognizable on their face. More particularly, the instant invention deals with a document that will be nonreplicable by modern photographic/photocopy techniques. Specifically, the photographic replication which is to be defeated by the instant invention is that which would result in or could be used to provide a color transparency or a high resolution positive (or negative) from which a printing plate may be made in order to reproduce the document that was photographed.

The instant invention, although unique in its own right, derives from one of the instant inventors' inventions dealing with nonreplicable documents and methods for producing same, subject of U.S. Pat. No. 5,018,767 issued on May 28, 1991 and entitled "COUNTERFEIT PREVENTION", and with priority established by Application PCT/US90/00221 in W090/08046, published Jul. 26, 1990 and hereinafter incorporated by reference. Those documents provide a significant portion of the background topic in the instant application.

DISCUSSION OF RELEVANT ART

In the early 1980's, with the proliferation of many fine photocopiers, it became apparent that, as the science progressed in terms of authentic replication and quality of print, the likelihood of counterfeited documents, including currency, would soon become a problem of national significance. Those skilled in the art of printing protected documentation, almost as a whole, attempted to create techniques and products which would frustrate the amateur, copy machine-operating counterfeiter by contriving documents which, when scanned by an electro-optical scanning system (such as that found in a photocopier machine, an image scanner or an opticon), would produce replicas which were darkened in tone or hue, or revealed hidden images, the most common such image being the word "VOID". A most interesting and relevant example of such art is disclosed in U.S. Pat. No. 4,582,346, issued to Caprio et. al. in April 1986 for a DOCUMENT SECURITY SYSTEM. In that patent, a protected document included background printed matter and line pattern printed warning indicia, a compound imaging process known as masking or cloaking. Upon an attempt to replicate the document by a copying machine, the warning indicia are slurred (a characteristic of all types of photocopiers) and become visible. Thus, by the patentee's own disclosure, the technique exploits copier directional slur, a phenomenon caused by toner drag, or the elongation of the trailing edges of images as toner is deposited onto copying drums. The resultant product is a document comprising a substrate having: a surface; background printed matter on a first portion of the surface; and warning printed matter (cancellation phrase) on a second portion of the surface, within the first portion. The warning printed matter is formed such that, upon xerographic copying of the document, the warning indicia slurs to become visible. The background printed matter is a dot pattern, printed on the face surface with a dot pattern screen of 5% density and 133 rows per inch. This density and pitch (the number of rows per inch) is significant in that, after one of the instant inventors had made the previously mentioned nonreplicable document (see Field of the Invention), a retrospective look at the above process reveal such was directed toward indicia that the copying machine could actually "see", that is, detect and photoprint.

U.S. Pat. No. 4,310,180 discloses a method of making a protected document. They disclose a protected document which is, in some respects, similar to predecessor methods, essentially preprinting a particular word, warning or cancellation phrase pattern in a half tone or multi-tone on a document and, thereafter, camouflaging the pattern by placing over the cancellation phrase a random line background mask and effecting the disappearance of the cancellation phrase into the background design. The instant inventors term this "cloaking" because there is a definite intent to mask one form of visible print with another.

In the interim, the period between the above Mowry, Jr. and Caprio type inventions and that of the instant inventors, other techniques were attempted such as microimaging in certain locations of the security document. For example, government printing offices, including the United States Bureau of Engraving, exploited the instant technique by including microimages in the borders and edges of pictures (images) and portraits (also images) in paper currency consisting of lineations of fine indicia. When attempts are made to reproduce such paper currency by color photocopier means, the microimages, but not line indicia, usually are lost. Unfortunately, the loss of an image which cannot ordinarily be seen, is generally of little consequence when one considers the fact that most currency exchanged in the open marketplace is rarely scanned by the handlers with a lens any more powerful than the unaided human eye. Thus, not only do the counterfeits of these currencies appear genuine to the casual observer, but the genuine notes are extremely expensive to produce, being attainable only through high quality engravings and intaglio printing techniques. However, the invention disclosed and claimed in U.S. Pat. No. 5,018,767 makes it possible for the first time to produce legal tender paper currency, genuine traveler's checks, original postage stamps, government issued food stamps, important documents or certificates such as driver's license and identification papers, and the like which, to the naked eye are identical to prior items of the same kind but, in fact, have characteristics which reveal their copier (especially color) replications to be obvious counterfeits.

It was discovered that a long-time bane of the printer, moire distortion, could be turned into a benefit. The moire image, in the optical sciences a virtual image because it is not the reflection of the real object nor the exact image being projected from the real object, is observed when an interfering grid is placed between the object to be observed and the observer. Analogously, this occurs in a photocopier or any electro-optical scanning device such as a television opticon when a grid or screen of some form prevents the detecting device (or surface) from "seeing" or sensing all of the light reflection from the object or target. It was reasoned that such a "grid" indeed exists in the aforementioned photocopying devices; and, that grid is the scanning and sampling pattern of the device itself. Quite literally, the device "sees" (samples and records) only the image directly under its scanning or imaging field; and that is an array of straight lines (the scan lines). Thus, if the device does not scan an object, it does not "see" it, does not record it, and does not replicate it. It is thus "blinded" by too small a sample and by a virtual grid corresponding to the scan line spacings, that is, "not see" zones. We recognized that in this sampling deficiency, lay the key to solving the copier replicating problem. We used the moire effect to reveal the bogus color copy of a genuine banknote, for example, by producing the banknote image lineation pitch (see definition hereinafter) in purposeful mismatch to the scanner frequency of a (color) copier. Additionally, the lay-down or printing pattern is deliberately altered, portionwise, in azimuth and/or pitch throughout the document by either a single printing (from a single plate) or a montage of either separate printings or a special compound (image) plate to alter the amount of data irregularly, with respect to the sampling band width.

During the later productions of the earlier (nonreplicable document) invention, as disclosed in, it was realized that the characteristic most notable in the attempted reproduction of the nonreplicable document, namely missing details (in addition to moire skewing), was also present when an attempt was made to produce a positive or negative image (photograph) transparency. Such photographic techniques are employed when a counterfeiter desires to produce a photo-etched plate for printing a security document.

Before summarizing and disclosing the instant invention in detail, it is first necessary to define several terms which shall be used hereinafter.

Definitions

Bloom or Flare. A phenomenon where light, either direct or reflected, overwhelms a recording medium, surface or device such as a photon detector, an ocular retina, a photographic emulsion or the like, so that the recording medium (or surface) does not record or sense all of the content in contrasting darker areas of the image, specifically the lineations comprising the image.

Bloomable or Flareable Image. An image which reflects light disproportionately from the various pixels that compose the image, by projecting to a recording medium diminished contrast between lighter and darker areas because of the preponderance of lighter pixels adjacent a darker one.

Dissonance. Mismatch between frequencies such as in different line pitches or color spectra. The term generally means "out of tune", non-synchronous or inharmonic.

Image. A marking made on a matte or integrally formed therein. An image may be lineations or arrays of dots, lines and marks that form pictures or portraits. The pictures or portraits are geometric patterns or images of persons and are generally comprised of variously oriented lineations.

Lineations. Multiple lines (separated by blank or colored spaces) in an etching, print, or similar reproduction which are comprised of dots, lines/hooks and swirls and comprise detail of which an image is made. A lineation may be straight or curvilinear and is merely a general description of in-line dots, lines/hooks and swirls.

Line Pitch. The frequency (f) of repetition in printed indicia such as lineations.

Matte. A substrate for containing an image therein or thereon. In the instant art, a matte is generally, but not always, a high quality rag or rice paper, polished to varying degree. It may also comprise printing plates, platens or similar picture formative means.

Picture Formative. Something such as an engraving, a photo-replicator or the like that is used to make or "form" images on suitable mattes by facilitating transfer of inks, dyes and similar marking stuff.

Pixel. Word coined from "pix", for picture and "el" for element.

Replication. An exact image or picture reproduction, true as opposed to imperfect, bogus or inaccurate. Hereinafter, replication, replica, etc. shall be used to express such a true reproduction; while nonreplication, nonreplicable, etc. shall mean that a document or image having such characteristics, when copied, appears counterfeit or bogus to the casual observer.

Stuff. The material out of which something may be shaped or made, raw or unwrought material.

SUMMARY OF THE INVENTION

Several techniques are employed to produce a photocopier or photographically nonreplicable image or document containing images:

(1) The rendition of images as dots (or lineations) surrounded by lighter dyes/paints/inks or print stuff and arrayed in omnidirectional formats comprises the heart of the instant invention, the basic bloomable image;

(2) subtle hue gradations on a matte for the purpose of decimating the reproductions is of significant importance, and has by itself the ability to frustrate accurate photocopying;

(3) the invention disclosed in the prior art "nonreplicable document method", namely, the inclusion of lines, dots and/or hooks/swirls (lineations) embodied and integrally formed into art, pictures and (other forms of) images so as to differentiate minutely in vertical and/or horizontal pitch from the linear grids and sampling protocols employed by the scanning mechanisms of electro-optical scanning and photocopy machines is used as an adjunct to the image of (1);

(4) use of a matte having definite relief, that is, high and low areas as with use of high quality rag bond and the like accentuates unequal reflection character; this irregular reflection character is further enhanced by using a dry offset printing technique, often coupled with image lineations done by intaglio printing, so as to effect extremely erratic reflectivity over the entire matte;

(5) omni-directional placement of the various lineations comprising the image, which enhances the bloom or flare aspects of the image; and (6) placement of the thinner (less dense) lineations of a bloomable image at a pitch beyond the resolving capability of a spherical camera lens and the emulsion grain of high resolution films, at least greater than 180 lines per inch, at which this latter and all of the aforesaid techniques are enhanced relative to the invention's ability to frustrate photography, as well as photocopy, of its images.

(7) xerographic imaging of the invention onto photosensitive plates or with transfer of a resinous powder to darker paper (matte) with subsequent thermal fixation (chromalin wipe). A fixed resin images glistens under photo light and blooms or flares specularly. This is another application of (1), above.

(8) the most expedient methods for making documents or picture formatives of the invention which include use of a photocopier (the machine targeted for vulnerability) to make the anti-photocopy document.

BRIEF DESCRIPTION OF THE DRAWINGS

Of the Drawings:

FIGS. 4A–4D are illustrations of the types of lines, dots and hooks used to construct lineations of the invention in graduated detail; and FIGS. 5A–5E comprise a series of illustrations which depict a general method for placing the image into picture formatives such as printing plates;

DETAILED DESCRIPTION OF THE PREFERRED EMBODIMENT

The image making techniques employed in the instant invention derive, in large part, from prolonged experimentation and practice with the invention disclosed in U.S. Pat. No. 5,018,767 and also U.S. application Ser. No. 473,903 (U.S. Ser. No. '903) filed on Feb. 2, 1990 upon which early priority for this application is based.

Article Embodiments

Figure 1A:
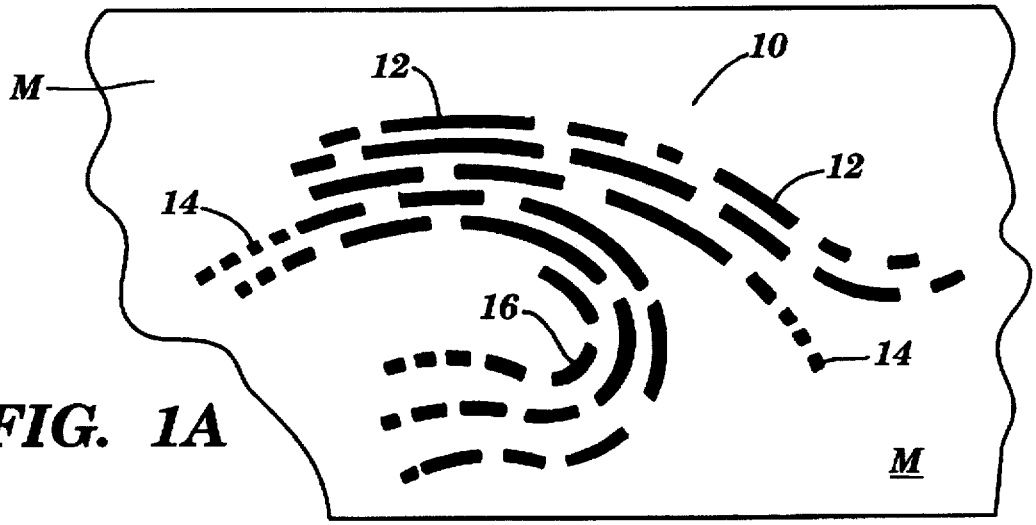
FIG. 1A is a small portion of a printed image.
Figure 1B:
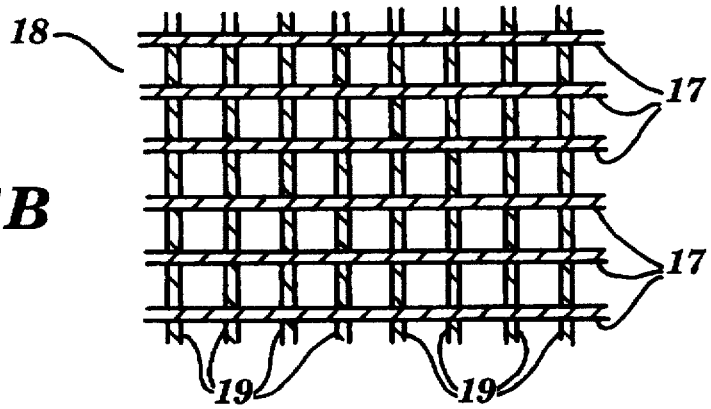
FIG. 1B is a grid overlay.
Figure 1C:
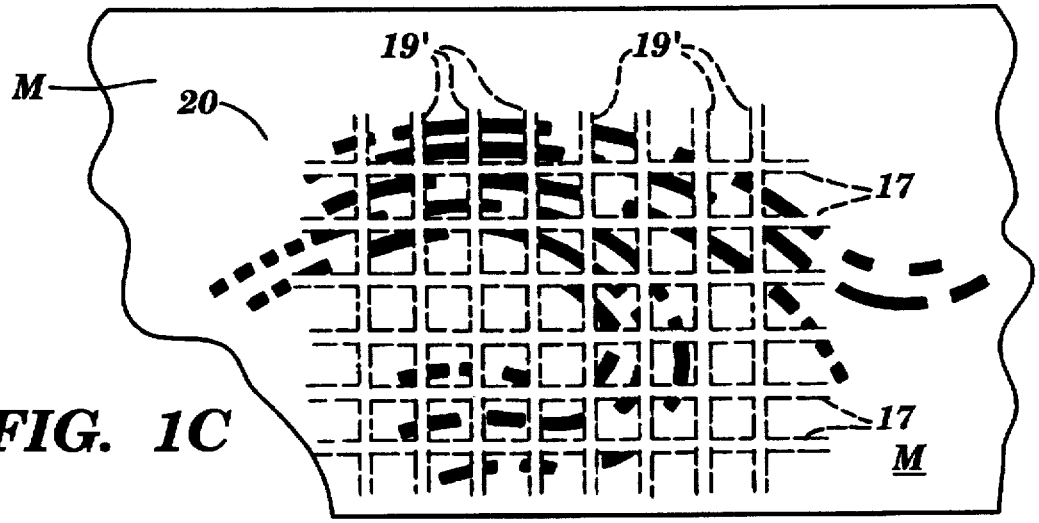
FIG. 1C is the superposition of the FIG. 1B grid on the FIG. 1A print.

Referring more specifically to the first three figures, FIG. 1A discloses the Ser. No. '903 inventions 10 rather succinctly. An image is created, on a suitable matte M by forming lineations, this is, linear and curvilinear marks that are comprised of lines 12, dots 14 and swirls 16, into pictures, portraits or other forms of visible imagery. "Curvilinear", as used herein, includes small curves or hooks at the ends of dots or lines. This is done according to a certain protocol which is illustrated in the following FIGS. 1B and 1C. In FIG. 1B, the reader observes a simple grid barrier comprised of opaque horizontal slats 17 and vertical slats 19. The spaces between the grid elements 17, 19 are indicated generally as voids 18. When a grid of the FIG. 1B type is laid over a FIG. 1A printing or imaging (assuming that the grid spacing or voids 18 is immutable), the FIG. 1C illustration demonstrates dramatically how a significant portion of the image of FIG. 1A would be lost to an observer (i.e. area obscured 17', 19') by interposition. Quite matter of factly, the grid vertical portions 19 may be removed and the reader can sufficiently imagine that, absent 19' parts of the interfering grid, the remaining image would still be sufficiently distorted so as to be apparent to the ordinary observer. This phenomenon, a very noticeable phenomenon, results in what is termed a moire pattern or color distortion; and, it occurs any time an observer attempts to view or record what is essentially a virtual image. The term virtual image is used herein because the viewer or recorder does not see/sense an image as it is accurately portrayed on its matte or substrate medium, but rather as it appears to the senses/sensor. It is an image which has been distorted by some interfering (here, a grid-like) phenomenon. The phenomenon may be real, such a grid of FIG. 1B or it too may be virtual or intangible, such as an inability to see or perceive. For example, if a person were to observe an image through a defective eye, say an eye which possessed a damaged retina so that the entire image was not sensed, the actual perception of the observer would be entirely different from that of an observer with normal vision. We choose to select a virtual grid for an actual one. This was done by first determining which type of device will be used to record a particular image—in this case, the imaging apparatus (recording) is a video scanner (opticon and the like), a photocopier scanner or a camera. In the case of the first two devices, an image 10 is made on a suitable matte M with lineations 20 (comprising dots, lines and swirls) spaced at a distance which will be minutely less or more than the scanning frequency, or some frequency factor such as (f÷an integer), of the aforementioned devices. Thus, when the optical scanning devices scan a document containing the above described image format, the points and lines along which the device scans, or "sees", will be recorded (spaces between scan lines are not) and later transferred to another matte in the reproduction protocol. Thus, for a short portion of its scanning protocol, the scanning device "viewing area" will be in registry with discrete image parts and the machine thereby recording lineation 20 of the image 10. However, and because of the purposeful line pitch dissonance between the machine or the device scanning pitch and the image lineations 20, the "seeing line" of the scanner will soon be out of registry with the lineation pitch of the image 10 and, since the device will no longer be able to "see" all of the lineations 20, the device will not be able to record and reproduce the document bearing the image with any reasonable degree of accuracy. Hence, the instant inventors use the term "nonreplicable document" to describe any document bearing an image such as that first described (10) because it cannot be replicated accurately.

Figure 2B:
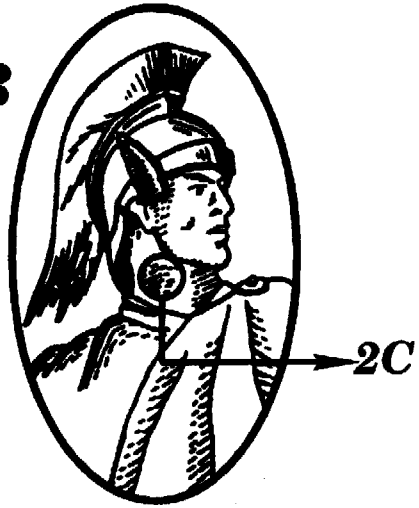
FIG. 2B is a stylized rendering of an image with a detail of the lineations forming the image.
Figure 2A:
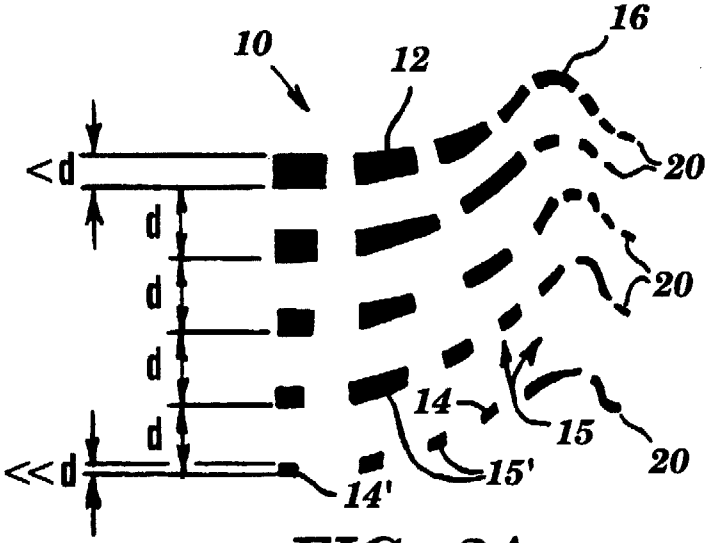
FIG. 2A is an alternate embodiment of a print similar to FIG. 1A.

The illustration at FIG. 2A explains in a somewhat more detailed fashion the invention related in FIGS. 1A–1C. Therein, the reader will note that the invention 10 comprising lineations 20, that is, lines formed of dots, lines and swirls, are arrayed so as to have a definite, predetermined pitch d. At this point, a second aspect of the instant invention is taught wherein the thickness of the lines or lineations 20 is varied, from line to line and also within the same lineation. At the top of FIG. 2A, a lineation thickness begins at the left hand side with a thickness somewhat less than the lineation pitch d, but according to the teachings of the instant inventors, all that is necessary is that the pitch distance d be an amount to purposefully create dissonance, i.e., more or less (a harmonic or a factor) than the scanning pitch of the scanning device which is to be frustrated. For most of the available color copiers on the market today, those capable of making a counterfeit document, pitches of greater than 180 lines per inch is generally sufficient. In the case of a well defined threat, it may be advisable to prepare face value documents, such as banknotes or currency, not only with a document lineation pitch slightly above or below the pitch protocol of the threatening device, but to embody varying pitches (switching between harmonics), pitch factors (f÷integer), azimuths (screen angles) and other aspects of the instant invention. Such an adoption leads to one of the most significant aspects of the instant invention, that which lends an antiphotographic character to the image 10, as well. In FIG. 2A, the bottom left hand lineation, comprised essentially of characters such as a lower left hand dot 14' is a thickness significantly less than the pitch distance d shown (d/3–d/10). This allows practice of the two features described in the Summary of the Invention relating to the use of subtle hue gradations on the matte serving as the substrate and the creation in that image of a blooming or flaring characteristic.

Relative to the use of the bloomable image and the tonal gradation, the instant inventors will digress slightly to more thoroughly explain these facets of the invention. Relative to tone, as it applies to the printing of documents, the actual print must be of a certain opacity and the density thereof should be at least 0.05 in reflective density, where such reflective density is proportional to the area that is being covered by the print. In the printing field, opacity is related on a relative scale of 0.0 to 3.0, the former being white-white and the latter, solid black. By contrast, in the photographic arts, black is 3.02. The average density (reflective) of a solid image in the printing art is 1.60. Reflective density on paper or similar substrate (matte) is also dependent on the substrate composition—called "trap". In such a case, the matte surface, being uneven allows the ink image to bleed or peek through to the other side and, in some cases, allows it to actually soak through to the second side or other side of the matte. This phenomenon is called "offset". This is the best exemplified if the reader examines a currency note and observes on the obverse that images bleed through from the reverse side. The offset phenomenon is only one factor, albeit an important one, in reducing the reflective density of the ink on one side of a printed document. Factors contributing more or less to offset are tack and pressure, of the ink and press, respectively. If a matte having definite relief is used, either using a matte design or making a preliminary intaglio "pressing" without ink, an unequal reflection character is acquired and this dissonant reflection character is further enhanced by using a dry offset printing technique, often used by the instant inventors with image matter that is done by additional intaglio printing (with ink), so as to effect extremely erratic reflectivity over the entire matte. Thus, an antiphotographic character is incorporated in documents printed according to the instant invention. Hereinafter, explanation will be made regarding the use of tonal gradations on or in the base matte which will further affect the overall reflective density of an antiphotographic document.

In photography, as well as electronic scanning, a phenomenon known as "flare" or "bloom" is known to exist. Indeed, patents have been obtained for printing techniques and products (made from the techniques) that incorporate reflective inks and dyes. The reflectivity of the inks or dyes used is obtained by including aluminized mylar particles or other reflective particles in the printing inks or dyes; until now, "bright" printing media have not been used. Irrespective of how the patentees term such techniques, what they mean to inculcate is the use of media having several reflective densities within a document. When such documents were photographed years ago, emulsion grains and ASA or din values were not yet obtainable that would be able to resolve the reflective discontinuities emitted or reflected by such documents. Today, however, with high speed, high resolution emulsions, something more is required to acquire a flare or bloom phenomenon in a document. Flare is essentially the effect of the interaction of lens curvature (in the camera) and reflections from juxtaposed light and darker surfaces in the document's image. The brighter light reflections have a more pronounced effect on the film and are gathered more readily by the curved lens; the light areas appear to "bloom" or flare, swamping out portions of the darker image, particularly at the margins. Although it would seem that external lighting could be all but eliminated from the photographic environment, light is still required to activate the film; and where the light-dark juxtaposition still exists, so does the flare or bloom. Referring once again to FIG. 2A, this character is incorporated in the instant invention by the spacing 15 of the lineations 20 so that the resultant images must be comprised of lineations having small enough thickness to exhibit a very low reflective density of from about 0.01 to 0.10. In such image areas, the resulting photograph of the document will reveal omissions of the image or extremely reduced replicas—in both size and density.

A very valuable, although somewhat limited, system for incorporating flare in the invention has also been discovered and used with considerable success by the instant inventors. In seeking elements that would induce the flarable feature so that camera, photocopier and telecopier machines or devices would be equally frustrated in a copying or transfer attempt, the inventors successfully applied a resinous powder to several forms of matte, papers that were somewhat darker than the usual copy paper. When the powder is permanently fixed by heat, several thermal cure or fixation methods are known, it results in an imaging which is clearly visible in ambient light because each indicium glistened, thus making the pattern of indicia or the image highly visible. However, any attempt to recopy the finished image by photographic means is unsuccessful and attempts to recopy by xerographic (photocopy) means or any optical scanning means (e.g., telecopier, photocopier) produced absolutely outstanding results in that the resultant product was completely altered. In this particular case, the bloom or flare aspect of the image indicia predominated over the line pitch/azimuth/dissonant character and, in fact, will suffice under the circumstances of use mentioned herein.

Figure 2C:
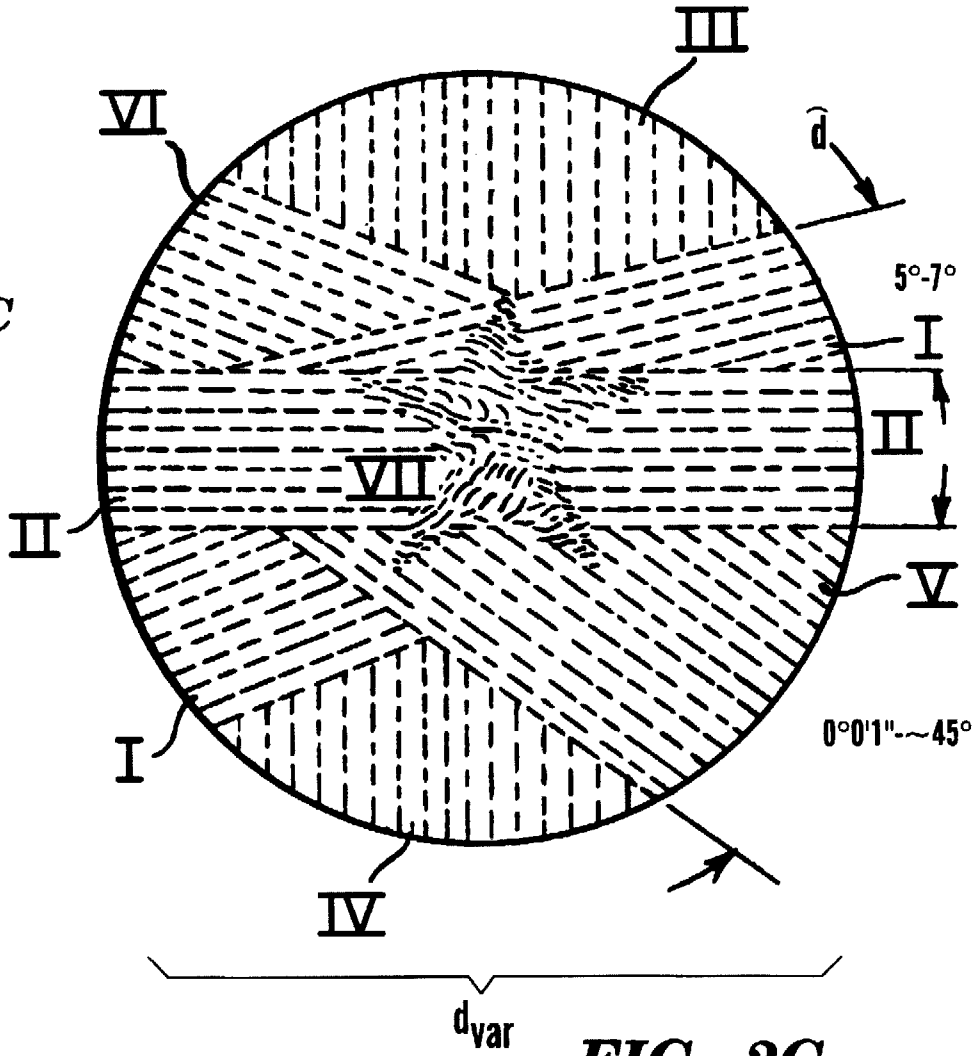
FIG. 2C is a detail of FIG. 2B.

FIG. 2B depicts, at the left hand side, an artist's sketch of what is normally a printed image seen in the traveler's check printed art. At the right, FIG. 2C, a detail of such an image is produced so that the invention disclosed in FIGS. 1A–1C is incorporated in sectors ranging from about 0 degrees to about 45 degrees in arc. Sector I is skewed from Sector II. Sector III, which is in alignment with Sector IV, is offset pitchwise so that a scanner, clearly "seeing" or sampling a line in Sector III, would probably miss lineation data in Sector IV. (See *Procedural Techniques*, hereinafter). This is assuming, of course, that the person attempting to counterfeit the image would have turned it so that the scanning device would scan orthogonally to the image lineations. Sectors V and VI differ in pitch d and in pitch azimuth $\hat{d}$ (arc d). Such a torturous layout is felt necessary to thwart counterfeiters that would attempt to take several (sampling) scannings along differing scan azimuths and use a computer to resolve inaccuracies or omissions on a pixel-by-pixel basis. Finally, Sector VII shows an embodiment of the basic techniques that may be embodied in a document utilizing the invention. In actual practice, and using practically any available color copier, an image created according to the detail of FIG. 2C, in a three or four color scheme, would be virtually nonreplicable in the sense that a casual observer would readily recognize the moire skewing (colorwise) and omissions in the photocopier counterfeit product.

Figure 3:
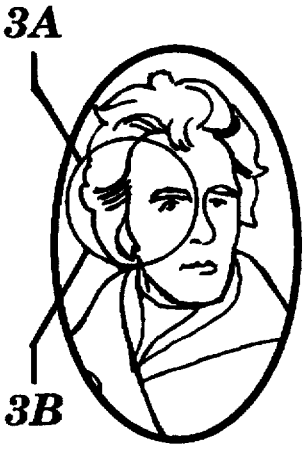
FIG. 3 is an artist's sketch of a well known portrait which appears on a national currency bill.
Figure 3A:
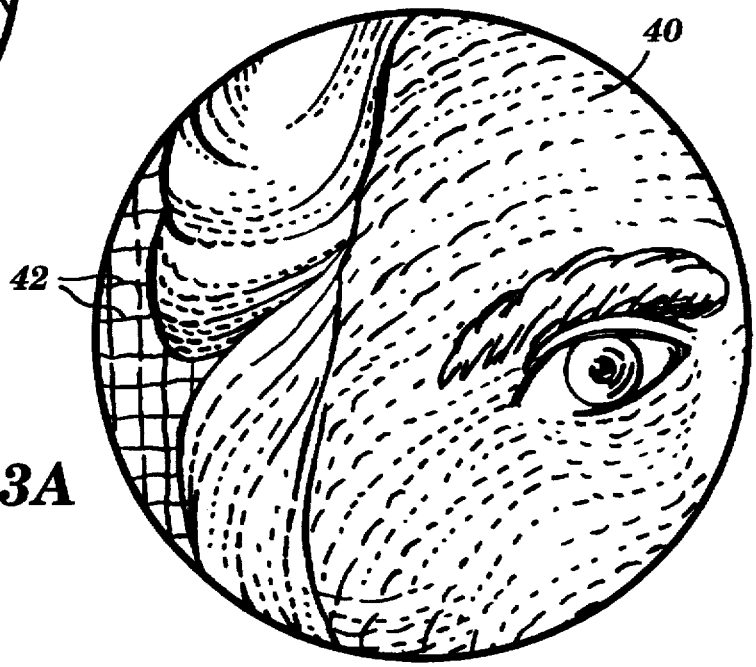
FIG. 3A is an artist's rendering of the print detail of the FIG. 3 image altered and embodying some of the elements of the instant invention.
Figure 3B:
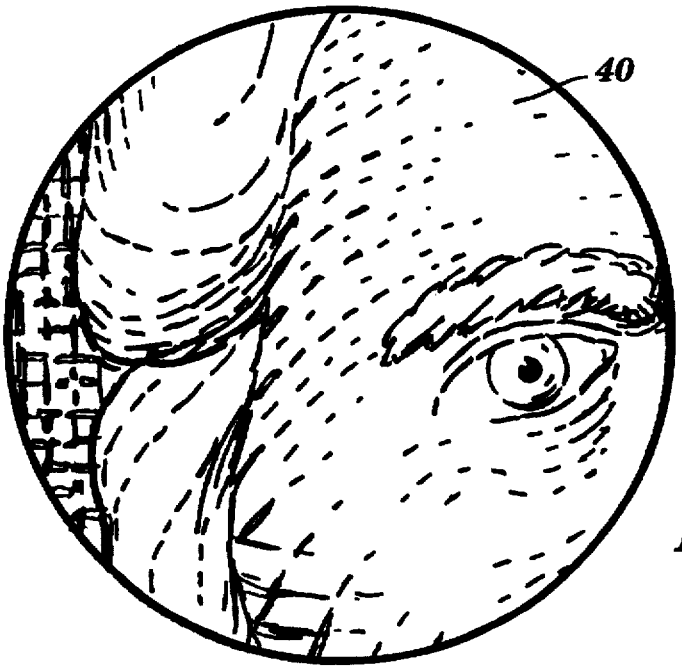
FIG. 3B is an artist's rendering of a copy of the FIG. 3A image as the copy would be produced by a modern photocopying machine.

FIG. 3 is an artist's rendering of the Jackson image as it appears in a United States twenty dollar bill. Since United States currency is produced from an engraving, and printed by the intaglio method, previously described facets of the instant invention, with the exception of tonal gradation, would appear as in FIG. 3A. Were such a prospective document copied on a color copier, even of the most modern type, the resultant (counterfeit) image of FIG. 3B would contain such obvious defects and omissions that the counterfeit virtually would be unpassable. Most noteworthy in the FIG. 3B effects would be the omission of detail 40 above the eyes, and loss of a great deal of the horizontal grid integrity 42 from the background areas of the portrait. In an attempt to adjust for loss of contrast, the counterfeiter would increase the toner laydown, thus acquiring a great deal of toner slur on the aspects of the image that were "seen" by the copier scanning device. Such an attempt to recreate background in darker tones areas would result in an accentuation (further decimation) in the areas of omission. Worse for the counterfeiter, toner slur would become more pronounced, and since the copy machine cannot reproduce what it has not seen, the attempted contrast adjustment will only serve to effect brighter spots where there was normally (or originally) a light hue. On some modern copiers, an averaging function is used for supplying toner (extra laydown) to compensate for nonscanned (unsampled) or "unseen" indicia in documents.

Procedural Techniques

One aspect of the invention is worthy of further discussion, the use of tonal gradation for the purposes of decimating photographic reproductions. In the newprint industry, the compositer (hand typesetter), now "pastes up" old ads from previous printings with new copy on the same page. The old copy, because of aging, has varying shades of "yellowing", i.e. from off-white to dull yellow. Such variable shading is similar to what the inventors term tonal gradation. Such advertisements contain writing and illustrations in line form, as well as half-tone. The procedure is to produce a negative of the full "paste up" on an offset reproduction camera. The bane of the compositer is the presence of the varying tones of yellow in paper, around and juxtaposed to type. These varying tones of yellow, or tone gradations, are apparent when compared to the overall opacity viewed in a negative area of the reversed image of the new ads. Thus, the sheet of total material, i.e., the matte with images thereon, suffers intermittent variations in tone and, as a whole, lacks consistency during reproduction. This problem actually arises because the darker shades of yellow retain density (in the negative) that will print darker than white (or a shade of gray) and all lighter shades of yellow, to and including white, will exhibit a similar effect. By purposefully incorporating, in the instant invention, a tonally graded (graduated) matte, the reflective densities of an overall document are further altered. Although making such a tonally graded matte is more in the province of the stockmaker, we choose to use one particular technique that is particularly effective and offers an additional enhancement to the preparation of a security document or face value certificate.

One of the methods for producing a document with the instant invention and, particularly the invention of the U.S. Pat. No. '767 is to make, as close as possible, a photoreplica of a true document on a modern color copier. Because the matte is altered by the heat of the developing process, the lineations of the replicated image will differ minutely from the scanning pitch of the copier. Thus, the replication will contain the instant invention. If the replication is made onto a plate, documents may now be printed containing the invention which has been literally provided by the copier. This was first taught in the U.S. Pat. No. '767. The replication may also be given the "feel" of a true printed document by merely overprinting or underprinting the copier (copy) with a common printer's varnish. The varnish would be applied by means of a print formative such as an intaglio of offset plate. Such a varnish is clear and often without hue or tone, but may contain such, particularly in the process colors. More than one layer is generally preferred. If at least one layer of varnish is applied by over/underprinting a copy machine replica, a document will be obtained having all the looks and "feel" (that is, sense to the touch), of a genuine certificate. In fact, it may serve as the genuine certificate and thus, embodying all the aspects of the instant invention, replace the genuine certificates of that type that are so easily counterfeited. If the printer wishes to incorporate the tonal gradation facet of the instant invention, more than one under/overprint of varnish or ink may be used. This time using a different toned or hued medium. In this instance, the plate for such printing is made so that the varying tones and hues of ink or varnish will be layed down "between" the lineations 20 or some other refraction-varying pattern that is employed. As those of ordinary skill may readily surmise, it is not necessary to apply this tonal gradation technique only to a photocopy or replica; but rather, it may be applied to any printed document, particularly offset printings. It is applied in this mode through use of multiple fountain techniques such as several foreign currency printers employ in applying several colors to a document.

In addition to overprinting with printer's varnish, a primary coat of varnish is applied directly to the matte. If that primary coat is one defining a sub-image not clearly visible to the unaided eye, the sub-image will be revealed upon attempted photocopier replication of the finished document and portions of an overprinted image will not be seen by the copier. Moreover, the varnish image is replicated either darker or of different color from the visible image, a distortion caused by the differences in refractive indexes of air and varnish (even though both appear to be clear and nearly invisible). We discovered that this image result can be consistently obtained whether or not one or more overlays of varnish are applied to the printed document.

It is possible to create a watermark by using as the primary coat a varnish which will penetrate the matte sufficiently that the varnish image is visible to the eye when the document is held up to a light source. Thus, although the matte has no transparency, the varnish image shows clearly; and if the image is a positive, it will replicate as a negative and vice versa.

FIGS. 4A–4D are graduated serial definitions of illustrations depicting, first in FIG. 4A, a portion of an image comprised of lineations of a certain pitch and an inner section 60 thereon. FIG. 4B is a detail of FIG. 4A taken at circle 4B. This is done to show the reader that the indica are lines, not only of different azimuth, but of different pitch, i.e. varying, as well. FIG. 4C is a larger detail of the FIG. 4B intersection 60 area. Finally, FIG. 4D is a blow-up and exaggeration of the intersection 60 area depicted as a rectangle in FIG. 4C. In a construction of an image according to the invention, lineations 20 are depicted as a series of lines, dots, hooks or swirls arranged according to a consistent pitch d' or varying pitches d". Machine scan lines $1_1$ and $1_2$ clearly illustrate how components of various lines would be "seen" by a photoscanning means, but also, critical portions would not be seen and recorded between the lines, herein depicted as a space s. As will be seen later herein, a couple of the techniques for embodying the invention in a document rely upon the maker of the particular picture formative (generally a printing plate) to take careful cognizance of the factors depicted in FIG. 4D. FIG. 4D is depicted with but two colors, a dark and a white, or black and white. Thus, an image may be formed in black lineations or what appear to be shades of black and gray. Were three colors to be used, the same techniques would apply for assuring that various components of the color would not be seen if other components were to be seen. FIGS. 5A–5E illustrate how one would go about making a plate formative, either by computer or hand engraving, so that the invention would be embodied in the formative and, of course, in the resulting document printed by the formative.

Figure 5A:
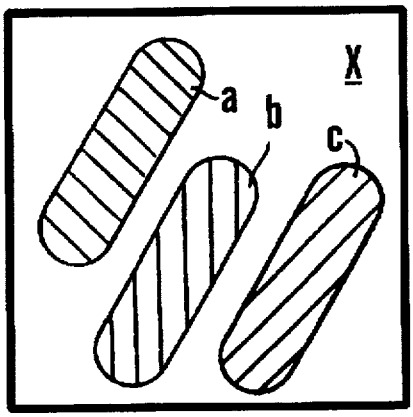
Figure 5B:
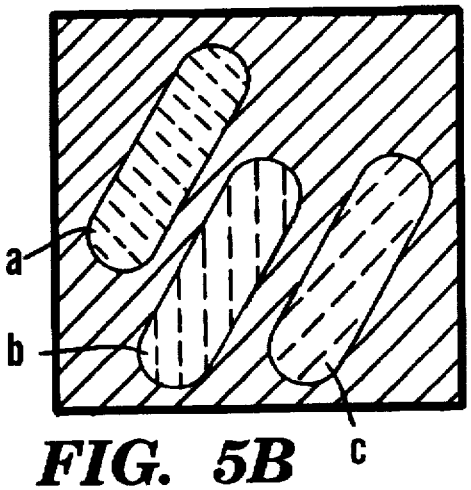
Figure 5D:
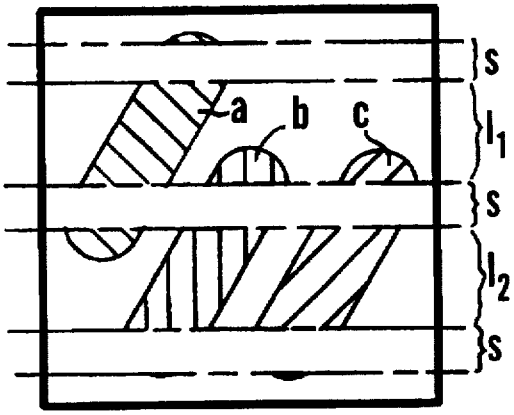
Figure 5D:
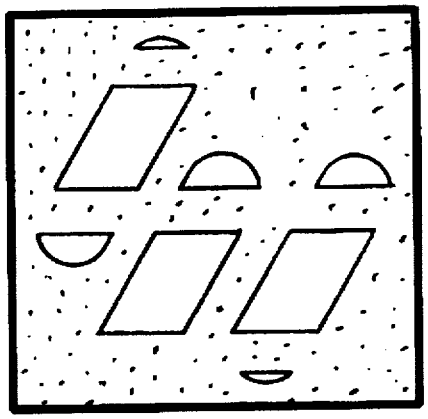
Figure 5E:
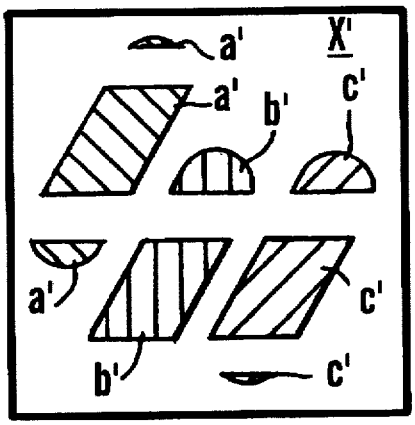

FIG. 5A represents a three color-component pixel X and the succeeding FIGS. 5B–5E illustrate the sequence of actions that would be taken to embody pixel X'. The process proceeds essentially as follows: a negative is made of the image thus rendering the three colors a, b and c distinctive as shown in FIG. 5B. Then, as depicted by FIG. 5C, a positive is made of pixel X screened with a preselected screen frequency as shown in FIG. 5C. Here, as in FIG. 4, $1_1$, $1_2$, etc. represent the photoscanner and photocopier scan lines; and s represents the spaces between the "seeing" scan lines, or the "no see" zones. FIG. 5D represent the pixel X as it would appear on a three color plate with the invention formed therein. The reader should note that when making the plate, and in order to maintain the proper color, tone and hue that was originally that of pixel X, it is necessary to compensate for the lack of color components by making deeper wells or using darker color components to print the document. Thus, colors a', b' and c to indicate their color and tone difference from the pixel of FIG. 5A.

By differentiating lineation pixels as described above, another error-inducing technique is provided. Of the pixel sample $P_s$ made by the copier in FIG. 5C, both lines $l_1$ and $l_2$, will be severely distorted: $P_s$ ($l_1$), sample $l_1$, will contain datum a (primarily) and only bits of data b and c; while $P_s$ ($l_2$), sample $l_2$, will contain predominantly data b and c with a paucity of datum a. Thus, the sampling protocol (within and part of the scanning protocol) is further frustrated, such techniques being more useful as two or more colors and varying densities are used in the publication of documents.

Final to the procedural techniques used in this invention is a pattern design activity that goes beyond the mapping techniques of U.S. Pat. No. '767, which suggested a printing that mapped characteristics of a photocopier product into an original document. This pattern design activity involves the pixel-by-pixel development of backgrounds for security documents which, irrespective of image construction, would produce the invention objectives when such documents are photocopied, in that they would produce copies that were severely deficient in the indicia that comprised their backgrounds. The aforesaid development consists in an analysis of the sampling function for a particular photocopier ("the target" against which the document is protected) to determine a deliberate placement of indicia with respect to each other so that sufficient number would be "unseen" by the copier (i.e., not sampled) during its complete scanning protocol. The analysis is mathematical in solution, in order to choose indicia of proper size, shape and density such that a certain percentage would not fall within the sampling function bandwidth (the "passband") of the copier or scanner. This type of analysis and subsequent synthesis has been used by communication engineers but not, to our knowledge, been employed in the fashion that we contemplated in U.S. Pat. No. '767 and refine further (i.e., independent of pitch or lineation frequency) in the instant invention. In retrospect, FIGS. 5A, 5B and 5C employ this design technique, in essence; but, one wishing to practice the invention in its fullest sense must resort to analysis of the target photocopiers' scanning function(s) in order to design patterns of indicia which, from several screen angles, provide excess data or information that would fall outside the passband and thus, be "unseen" by the copier. The final product is obtained empirically, using modern printing techniques. Analysis is performed by examination of the target copier's copies. Practice with the invention is the fundamental pedagogic tool.

What is claimed is:

1. A method for making an image-bearing document non-counterfeitable with respect to a copier which employs an electro-optical scanning and sampling copy protocol comprising:

identifying the blind or non-sampled zones in said copy protocol;

preparing a document substrate; and placing indicia which comprise at least one image onto said document substrate so as to fall into areas that are not sampled by said copy protocol when said image-bearing document is copied by said copier.

2. The method of claim 1 wherein said placing is characterized by printing said indicia of said at least one image to uniformly misregister with sampling zones of said protocol of said copier thus effecting non-copyability of a portion of said at least one image by said copier.

3. The method of claim 2 wherein said printing to uniformly misregister is further characterized by selecting a frequency of said protocol and effecting said printing onto said document substrate at, near or at an integral factor of a recurring rate of said sampling zones and to register with blind or non-copy zones of said protocol.

4. The method of claim 3 wherein said preparing further comprises providing said substrate with a tonally graded hue.

5. The method of claim 4 wherein said hue comprises a portion of the color spectrum from white to yellow.

6. The method of claim 4 wherein said providing comprises printing with a varnish.

7. A method for making a document, bearing a pattern of image-defining indicia and which is counterfeit-proof by an electro-optical copier having a scanning-sampling copy protocol, said protocol defined by sampling zone repetition with blind zones therebetween, said method comprising identifying said blind zones by ascertaining a sampling zone pattern and thereby the blind zones disposed between samples thereof and printing on a suitable substrate indicia of at least one image so that said indicia fall within said blind zones of said copier copy protocol, effecting upon copying by the copier, a distortion/decimation of said image in color or feature.

8. The method of claim 7 wherein said printing further comprises placing said indicia as uniformly recurring lineations.

9. The method of claim 8 wherein said uniformly recurring is a frequency or integral factor thereof being used by said copier in said scanning-sampling protocol.

10. The method of claim 9 wherein said method for making further comprises a step of selecting a tonally graded substrate.

11. A copier non-counterfeitable document comprising a substrate bearing thereon at least one image that is composed of lineate indicia which appear at lineation frequencies characteristic of a scanning-sampling copy protocol of said copier to effect registry with predetermined and positionally identified blind or non-copy zones of said copy protocol when said document is copied by said copier and thereby result in a copy which is ommissive and distorted in said image.

12. The document of claim 11 wherein said indicia have a thickness ranging from about d/3 to about d/10 where d is at least one of said spatial frequencies.

13. The document of claim 11 further comprising said at least one image bearing therein indicia having reflective densities of about 0.01–0.10.

* * * * *